United States Patent [19]

Terry

[11] 4,125,164

[45] Nov. 14, 1978

[54] APPARATUS AND METHOD FOR LIFTING A BOP FROM A WELLHEAD

[76] Inventor: William A. Terry, 4620 Foxboro Ave., Bakersfield, Calif. 93309

[21] Appl. No.: 827,166

[22] Filed: Aug. 24, 1977

[51] Int. Cl.[2] ..... E21B 33/03

[52] U.S. Cl. ..... 166/315; 166/85; 254/93 R

[58] Field of Search ..... 166/315, 75, 77.5, 85, 166/79; 175/202, 219, 207, 209; 254/93 VA, 93 R

[56] References Cited

U.S. PATENT DOCUMENTS

| | | | |
|---|---|---|---|
| 3,023,808 | 3/1962 | St. John | 175/209 |
| 3,097,826 | 7/1963 | Walker | 254/93 R |
| 3,857,450 | 12/1974 | Guier | 175/207 |
| 4,007,782 | 2/1977 | Nybo et al. | 166/85 X |
| 4,022,026 | 5/1977 | Childress | 175/219 |

*Primary Examiner*—Ernest R. Purser
*Attorney, Agent, or Firm*—Max E. Shirk

[57] ABSTRACT

A vehicle carries a hydraulic reservoir, a pump, a portable fluid-distributing valve, four or more hydraulic rams and conduits connecting the reservoir, pump, valve and rams in a hydraulic circuit such that the valve and rams may be removed from the vehicle. The rams are then connected to a BOP and beams under the rig floor; the valve is held by an operator a safe distance from the BOP and manipulated to uniformly and safely lift the BOP.

4 Claims, 8 Drawing Figures

APPARATUS AND METHOD FOR LIFTING A BOP FROM A WELLHEAD

BACKGROUND OF THE INVENTION

1. Field of the Invention

The present invention relates to lifting devices and more particularly to a new and useful hydraulic device especially designed for lifting a BOP from a wellhead uniformly, safely and efficiently.

2. Brief Description of the Prior Art

Prior art known to applicant from a preliminary search comprises the following United States Patents:

Owens, No. 2,661,063;
Ortloff, No. 2,897,895;
Shaffer, No. 3,241,864;
Watkins, No. 3,884,298; and
Nybo et al, No. 4,007,782.

Owens suggests to use a pair of hydraulic jacks to exert an upward force on a collar attached to pipe in a well by shearable pins which will shear when the pipe gets stuck. This causes a downward jar or jerk on the pipe, thus loosening the pipe.

Ortloff discloses a blowout device for oil wells which is characterized by a two stage seating of a clamp and the use of a sealing fluid to prevent leakage between the clamp or clamps, the housing and the pipe string. The initial seating of the clamp is secured by the application of hydraulic or pneumatic force exerted from without the assembly.

Shaffer discloses an automatic connector for oil-well drilling, casing and cementing strings. The connector includes a hollow mandrel telescopically received and adapted to be locked within a hollow barrel member, locking means carried by the barrel for locking the mandrel and barrel together, retaining means for preventing the locking means from disconnecting or releasing the barrel and mandrel elements, and unlocking means for moving the locking means away from the retaining means and for releasing the barrel from the mandrel.

Watkins discloses apparatus and method for preventing wear on a sub-sea wellhead assembly or the like wherein a BOP stack is mounted on the wellhead assembly having a string of pipe extending therethrough down into the well borehole. A plurality of rams are mounted at spaced locations on the BOP stack and movable in a direction generally normal to the central longitudinal axes of the string of pipe. Each ram carries a removable wear pad and all of the rams are movable simultaneously from a first position out of engagement with the string of pipe to a second position where the wear pads abut against and surround the string of pipe. In this manner, any wear of the string of pipe on the BOP stack is taken up by the wear pads which can be removed and replaced when necessary. In addition, drill pipe wiggle is restricted by the engagement of the pipe. Hydraulic fluid may be used to actuate the rams remotely between the first and second positions.

Nybo et al disclose a parking device for containing a BOP aboard a floating drilling station. The parking device includes a parking frame which is capable of holding the BOP with its center of gravity lying above the points at which the BOP is supported on the parking frame. The BOP can be moved as a unit back and forth between a parked position and an installed position for utilization on the drilling station. For enabling such movement a first drive mechanism is provided for raising and lowering the parking frame and additionally a second drive mechanism is provided for moving the parking frame sideways.

Prior art is also known to applicant from experience in the field.

The block-and-tackle on an oil-well drilling rig may be used to position a 20,000–70,000 lb. blowout preventer (BOP) and spacer spool on a wellhead. During drilling operations, it is sometimes necessary to lift the BOP spool assembly a foot or so above the wellhead while the block-and-tackle is in use supporting a casing string.

Conventionally, the BOP-spool assembly is lifted the required 12 to 16 inches with four or more come-alongs; at least four are required for a uniform lift; as many as eight may be required to lift a 70,000 lb. BOP. Each come-along includes a handle which must be manipulated by a worker standing on a catwalk which is usually muddy and slippery. It is not uncommon for a worker to obtain additional leverage by slipping a long length of water pipe over the come-along handle. This method of lifting a BOP is not only dangerous, but it is very time consuming. Additionally, it is difficult for the workers to manipulate the come-along handles in unison, which is essential for a uniform lift.

SUMMARY OF THE INVENTION

According to the present invention, an apparatus and a method are provided for lifting a BOP from a wellhead located within the confines of a drilling-rig subbase having a rig floor including a network of I-beams each having a lateral lip.

The apparatus may be provided on a pickup truck which may be driven to the well site and may include a plurality of hydraulic rams each having a cylinder which may be connected to the rig floor and a piston rod which may be connected to the BOP. A reservoir of hydraulic fluid may be mounted on the truck in fluid communication with the inlet of a pump having an outlet connected to a fluid-distribution valve by a flexible hose or conduit of sufficient length that the valve may be removed from the truck and carried to a convenient location for hand-held operation. Additional hoses may be used to connect the valve to the reservoir and each ram to the valve. The valve may be designed to have a first position permitting fluid to flow from the pump to the reservoir, a second position permitting fluid to flow from the pump to each ram and a third position permitting fluid to flow from each ram to the reservoir.

The method may include the steps of locating the truck adjacent the wellhead, connecting the reservoir outlet to the pump inlet, connecting the reservoir inlet to the reservoir-outlet on the valve, connecting the pump outlet to the pump-inlet on the valve, connecting each of the ram inlet-outlets on the valve to a ram, connecting each of the hydraulic cylinders to a lip on an I-beam, connecting each of the piston rods to the BOP and positioning the valve to direct fluid from the pump to the rams.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

DESCRIPTION OF THE PREFERRED EMBODIMENT

Figure 1:
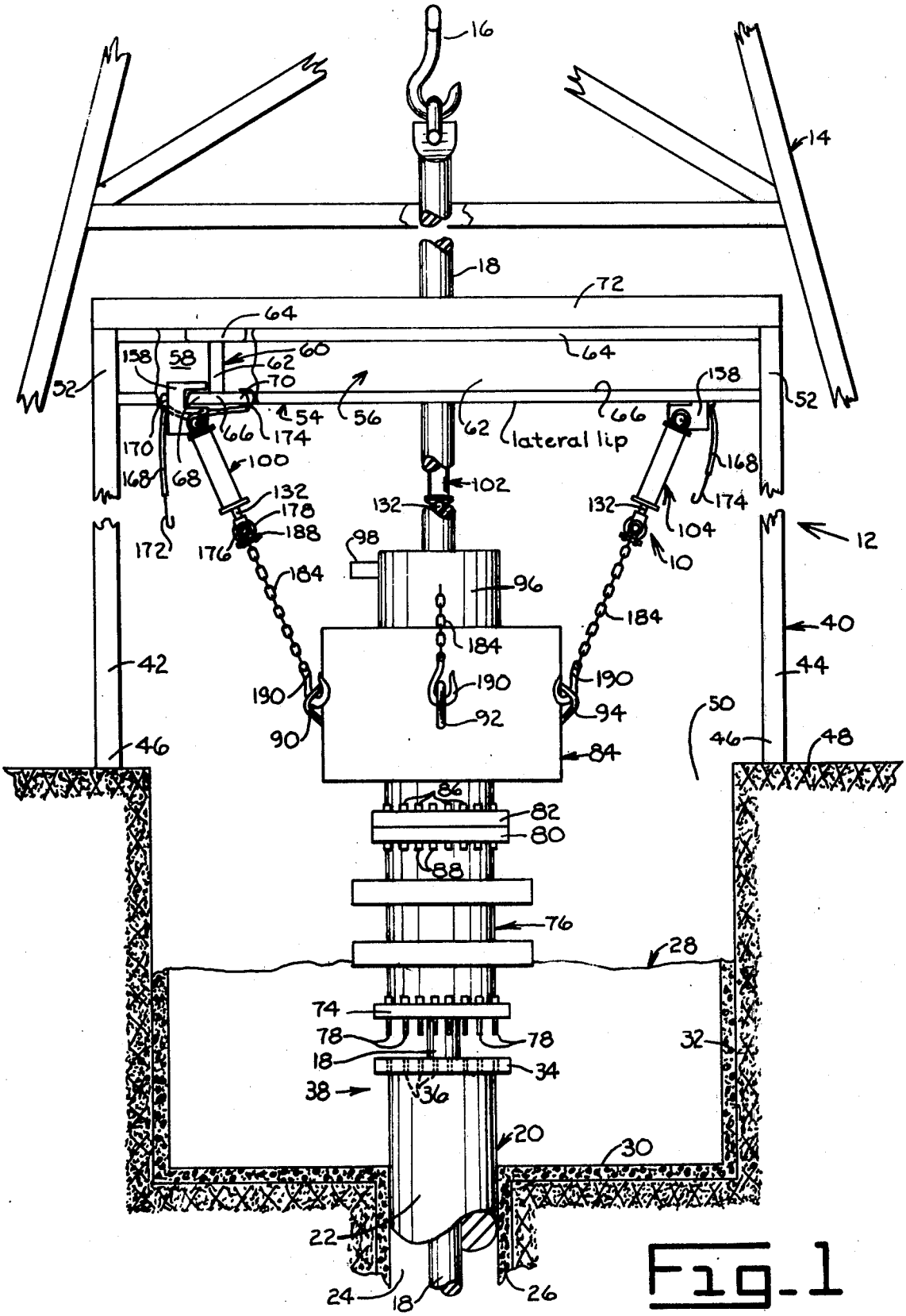
FIG. 1 is a front elevational view of an apparatus of the present invention in position on a rig sub-base and a BOP.

Referring again to the drawings and more particularly to FIG. 1, an apparatus for lifting a BOP (blowout preventer) from a wellhead, generally designated 10, is shown in combination with a drilling rig 12 including a rig mast 14 having a conventional block-and-tackle (not shown) including a hook 16 which may be used to support an inner casing 18 extending downwardly through an outer casing 20 having an upper end 22 which may be cemented into a well bore hole 24, as indicated at 26.

The upper end of outer casing 20 is surrounded by a concrete celler, 28, which includes a floor 30 and an encompassing sidewall 32, and is provided with an annular flange 34 having a plurality of bolt holes 36 provided therein. Upper end 22 of outer casing 20 and flange 34 define a wellhead 38.

Drilling rig 12 also includes a rig sub-base 40 having a plurality of upstanding legs, like the two shown at 42, 44, each including a lower end 46 supported at ground level 48 adjacent a cavity 50 provided for cellar 28. Each leg 42, 44 includes an upper end 52 to which a network of I-beams 54 is affixed. This network may include a front I-beam 56, a rear I-beam 58 and a plurality of transverse I-beams, like the one shown at 60. Each beam includes a web portion 62, an upper flange 64 and a lower flange 66. As best shown for the beam 60, each lower flange 66 includes a first lateral lip 68 extending outwardly from one side of web portion 62 and a second lateral lip 70 extending outwardly from the other side of web portion 62.

I-beams 56, 58, and 60 may be of about an 8 inch size and may support a rig floor 72 which may be made from suitable 2 × 12 pieces of lumber forming a cat walk above cellar 28.

The flange 34 on wellhead 38 is adapted to receive the lower flange 74 on a spool 76 which may be affixed to flange 34 by a plurality of bolts 78 and associated nuts (not shown). Spool 76 includes an upper flange 80 to which the lower flange 82 of a BOP 84 may be affixed by a plurality of bolts 86 and nuts 88. BOP 84 may be provided with a plurality of lifting bails, like the three shown at 90, 92 and 94, and supports a mud-flow nipple 96 having an outlet port 98.

As is well-known to those skilled in the art, BOP 84 may weigh from 20,000 to 70,000 lbs. and is initially placed in position on wellhead 38 by hook 16. However, at one stage in the drilling operation, it is necessary to lift BOP 84 and spool 76 about 12 or 16 inches above wellhead 38 while hook 16 is being used to support inner casing 18. Apparatus 10 may be used for performing this lifting operation and includes a plurality of hydraulic rams, like the three shown at 100, 102 and 104. Each ram may conveniently have a capacity of 12,000 lbs. so that four rams may be used to lift a BOP weighing up to 48,000 lbs. Six rams could be used to lift a BOP weighing up to 72,000 lbs. Apparatus 10 will be hereinafter described for purposes of illustration, but not of limitation, as employing four rams. The rams may be identical and ram 100 will now be described in connection with FIGS. 2–5.

Ram 100 includes a hydraulic cylinder 106 having an upper end 108, a lower end 110 and an encompassing sidewall 112. Upper end 108 and lower end 110 may be closed by end caps 114, 116, respectively, held in firm engagement with cylinder 106 by four tie rods 118, 120, 122, and 124. An air vent 126 is mounted in upper end cap 114 in fluid communication with cylinder 106 upstream of a piston 128, which is reciprocably mounted in cylinder 106, and a fluid inlet-outlet port 130 is mounted in lower end cap 116 in fluid communication with cylinder 106 below or downstream of piston 128. Ram 100 also includes a piston rod 132 which is affixed to piston 128 and which extends through an aperture 134 provided in lower end cap 116.

Figure 4:
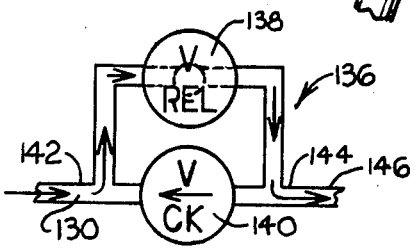
FIGS. 4 and 5 are schematic views showing the direction of flow through the relief and check valves used on the ram of FIG. 2.
Figure 5:
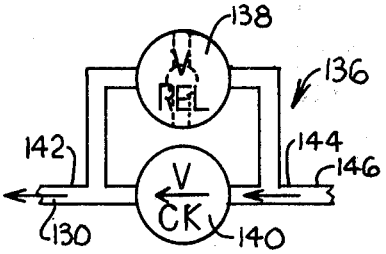

Flow of hydraulic fluid through inlet-outlet port 130 is controlled by a valve assembly 136 including a release valve 138 and a check valve 140 connected together in a parallel circuit, as shown schematically in FIGS. 4 and 5. Valve assembly 136 also includes a downstream end 142, which is connected to inlet-outlet port 130, and an upstream end 144, which is connected to the first end 145 of a hose 146, which will be referred to sometimes hereinafter as a "fourth conduit". Valve assembly 136 is protected by an arcuate metal shield 148 affixed to lower end cap 116. A handle 150 may be affixed to shield 148 to facilitate carrying ram 100.

Ram 100 also includes a pair of spaced-apart, upstanding brackets 152, 154 which are affixed to upper end cap 114 and each of which includes an aperture 156. A shackle 158 may be connected to brackets 152, 154 by a pin 160 which passes through apertures 156 and which is retained in position in aperture 156 by a pair of hair pin-type fasteners 162, 164. Shackle 158 includes an open throat portion 166 adapted to engage lateral lip 68 (FIG. 1) on beam 60 for connecting ram 100 thereto. Shackle 158 may be retained in position on lip 68 by a rubber strap 168, which is connected to shackle 158 by a clip 170, having a pair of hooks 172, 174 adapted to engage lip 70 on beam 60.

Ram 100 also includes a bifurcated hanger 176 (FIG. 3) which is affixed to piston rod 132 and which has a clevis 178 affixed thereto by a pin 180 retained in position on hanger 176 by a fastener 182. A chain 184 has a link 186 connected to clevis 178 by a pin 188 and is connected to BOP 84 by a hook 190 (FIG. 1) which engages lifting bail 90. It is to be understood that rams 102, 104 and a fourth ram (not shown) are also connected to rig sub-base 40 by shackles 158 and to BOP 84 by chains 184 and hooks 190.

Figure 6:
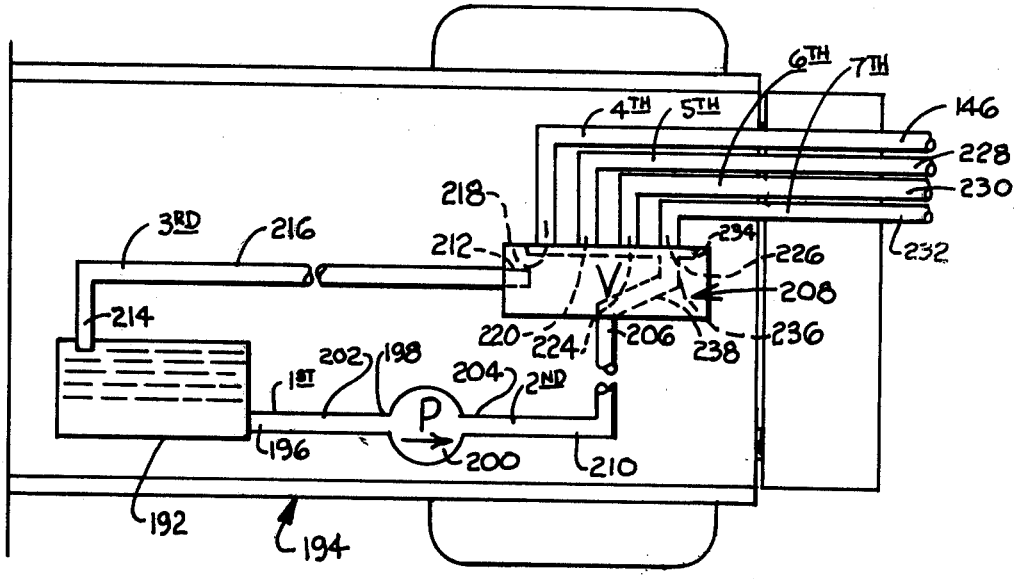
FIG. 6 is a partial top plan view of a pickup truck having the reservoir, pump, fluid-distribution valve and conduits of the present invention mounted thereon.
Figure 7:
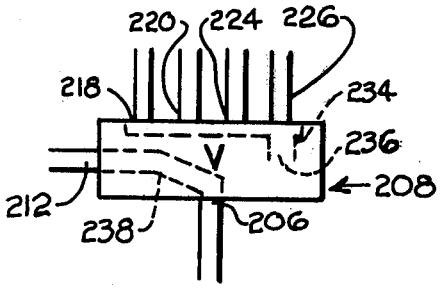
FIGS. 7 and 8 are schematic views showing the valve of FIG. 6 in different operating positions.
Figure 8:
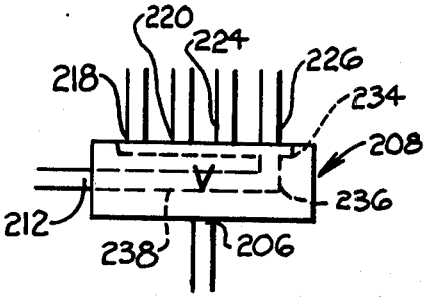

Referring now to FIG. 6, apparatus 10 also includes a hydraulic fluid reservoir 192 which may be mounted on a pickup truck 194 and which includes an outlet 196 connected to the inlet 198 on a pump 200 by a first conduit 202. Pump 200 includes an outlet 204 connected to an inlet 206 on a fluid-distributing valve 208 by a second conduit 210. Valve 208 includes a reservoir-outlet port 212 which may be connected to an inlet port 214 on reservoir 192 by a third conduit 216. Valve 208 also includes a plurality of inlet-outlet ports 218, 220, 224 and 226 which may be connected to rams 100,102, 104 and a fourth ram (not shown) by the fourth conduit 146, a fifth conduit 228, a sixth conduit 230 and a seventh conduit 232, respectively. Ports 218, 220, 224 and 226 communicate with a manifold 234 which is provided inside valve 208 and which includes a port 236 adapted to communicate with a channel 238 which is provided in valve 208 for placing valve inlet 206 in communication with port 236, as shown in FIG. 6. Channel 238 may be positioned as shown schematically in FIG. 7 to place valve inlet port in fluid communication with reservoir-outlet port 212 or to the position shown schematically in FIG. 8 to place reservoir-outlet port 212 in fluid communication with manifold port 236. Valve 208 may be readily removed from truck 194 and held by an operator in a convenient location so that the operator may observe the hydraulic rams in operation as hydraulic fluid is supplied thereto through conduits 146, 228, 230 and 232. When not in use, valve 208, conduits 146, 228, 230 and 232 and rams 100, 102, 104 and a fourth ram (not shown) together with their associated chains and shackles, may be carried on truck 194.

According to the method of the present invention, truck 194 may be located at ground level 48 adjacent drilling rig 12. Rams 100, 102, 104 and a fourth ram (not shown) and their associated shackles 158 and chains 184 may be removed from truck 194; the open throat portion 166 of each shackle 158 may be engaged on a lateral lip 68 on an I-beam and retained in position thereon by engaging hooks 172, 174 on a lateral lip 70. Hooks 190 may then be engaged on an associated one of the bails 90, 92, 94 or a fourth bail (not shown); bolts 78 may then be removed from their associated nuts (not shown) to free flange 74 on spool 76 from flange 34 on well head 38.

Figure 2:
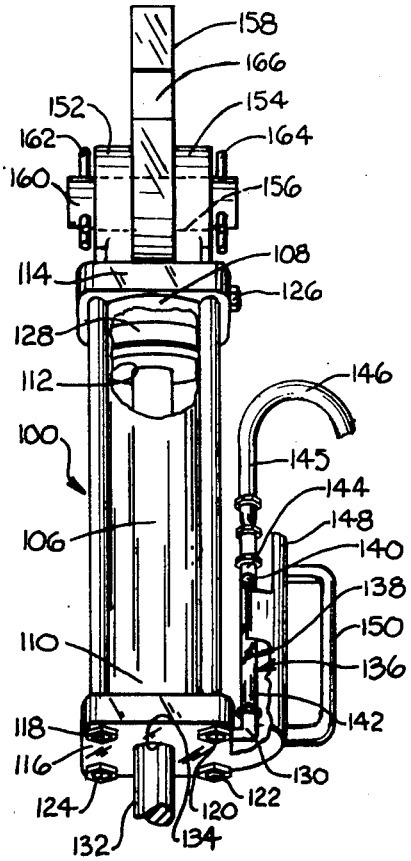
FIG. 2 is an enlarged, front elevational view of one of the rams shown in FIG. 1.
Figure 3:
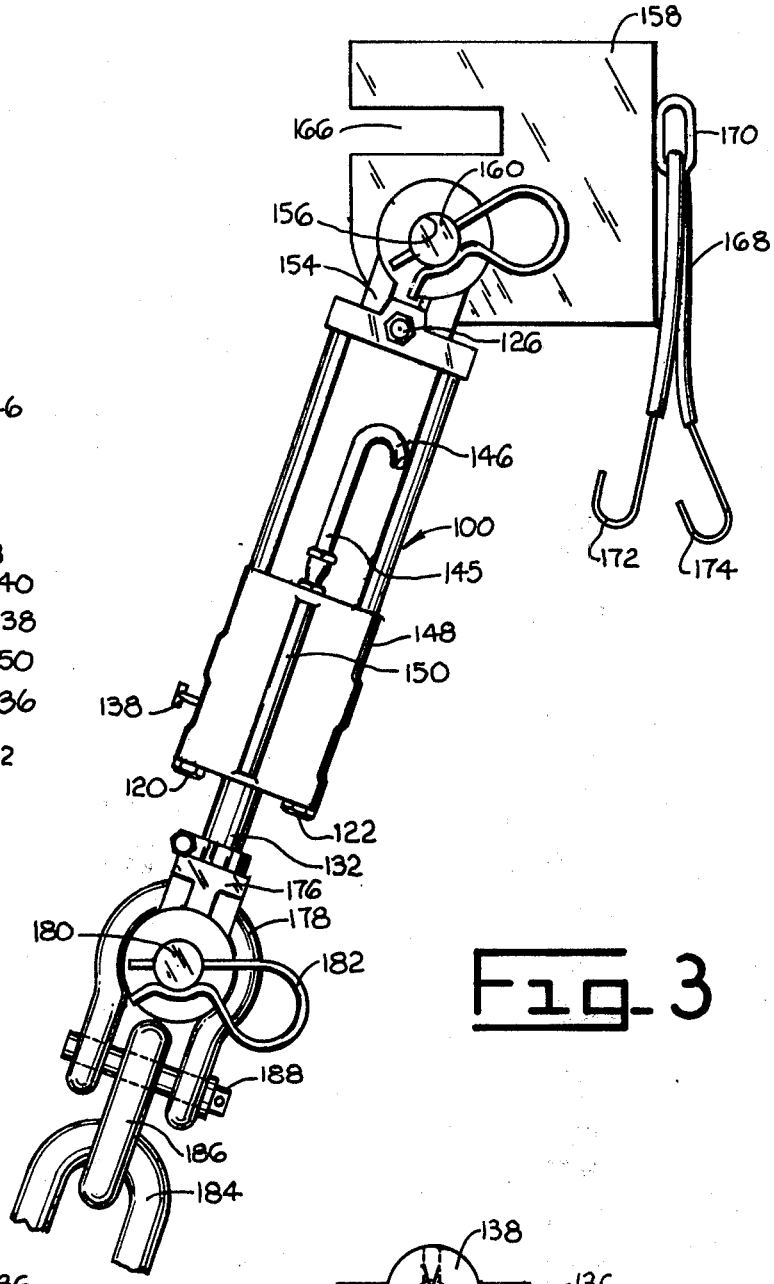
FIG. 3 is a side elevational view of the ram of FIG. 2.

Assuming that (1) the first conduit 202 has been connected to reservoir outlet 196 and pump inlet 198, (2) the second conduit 210 has been connected to pump outlet 204 and valve inlet 206 and (3) the third conduit 216 has been connected to inlet port 214 on reservoir 192 and reservoir outlet port 212 on valve 208, then valve 208 may be removed from truck 194, if desired, and carried to a convenient location. Conduits 146, 228, 230 and 232 may then be connected to valve 208, as shown in FIG. 6, and to the hydraulic rams, as shown in FIGS. 2 and 3 for the ram 100. Relief valves 138 may then be closed, as indicated schematically in FIG. 5; valve 208 may then be set to the position shown in FIG. 6 so that pump outlet 204 will be placed in fluid communication with manifold 234 and pump 200 may be energized to pump hydraulic fluid under pressure to each hydraulic ram beneath its piston 128 for moving piston 128 toward end cap 114. This will lift BOP and spool 76 from well head 38 a desired amount whereupon valve 208 may be set to the position shown in FIG. 7 where pump inlet 206 is in fluid communication with reservoir outlet port 212 while the check valves 140 prevent reverse flow from the hydraulic rams.

Inner casing 18 may then be severed adjacent well head 38 and removed by hook 16. Spool 76 may also be removed and replaced by another spool if desired. Valve 208 may then be set to the position shown in FIG. 8 so that manifold 234 will be placed in fluid communication with reservoir outlet port 212; relief valves 138 may then be opened, as indicated schematically in FIG. 4, so that hydraulic fluid will flow from the hydraulic rams back to reservoir 192 and BOP 84, together with its associated spool, will be lowered onto flange 34.

While the particular apparatus and method herein shown and described in detail are fully capable of attaining the objects and providing the advantages hereinbefore stated, it is to be understood that they are merely illustrative of the preferred embodiments of the invention and that no limitations are intended to the details ofconstruction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. In combination with a vehicle, apparatus for lifting a BOP from a wellhead located within the confines of a drilling-rig sub-base having a floor including a network of I-beams each having a lateral lip, said apparatus comprising:

a plurality of hydraulic rams movably attached to fluid supply means on said vehicle, each of said rams having a cylinder including an upper end and a lower end, a piston reciprocably mounted in said cylinder, a piston rod having a first end affixed to said piston and a second end extending out of said lower end of said cylinder, a check valve mounted in said lower end of said cylinsder for admitting hydraulic fluid to said cylinder below said piston while preventing reverse flow of fluid from said cylinder and a relief valve mounted in said lower end of said cylinder in parallel with said check valve for controlling flow of fluid from said cylinder;

first means on each of said rams for removably connecting one of said upper end of each of said cylinders and said second end of each of said piston rods to said rig floor;

second means on each of said rams for removably connecting the other of said upper end of each of said cylinders and said second end of each of said piston rods to said BOP;

said fluid supply means comprising a reservoir of hydraulic fluid affixed to said vehicle;

a hydraulic pump affixed to said vehicle, said hydraulic pump having an inlet and an outlet;

a portable fluid-distributing valve movably attached to said supply means on said vehicle, said fluid-distributing valve having a reservoir-outlet port, a pump-inlet port, an inlet-outlet port for each of said hydraulic cylinders and third means for selectively placing said reservoiroutlet port in fluid communication with said pump-inlet port and said inlet-outlet ports, respectively, and said pump-inlet port in fluid communication with said reservoir-outlet port and said inlet-outlet ports, respectively;

a first conduit connecting said reservoir to said pump inlet;

a second conduit connecting said pump outlet to said pump-inlet port on said fluid-distributing valve;

a third conduit connecting said reservoir to said reservoir-outlet port on said fluid distributing valve, said second and third conduits being of sufficient length to permit a user of said apparatus to carry said fluid-distributing valve a predetermined distance from said vehicle for manipulation of said third means by said user; and additional conduits each connecting one of said inlet-outlet ports on said fluid-distributing valve to one of said hydraulic cylinders, whereby said third means may be moved to a first position placing said pump in fluid communication with said rams to lift said BOP, to a second position placing said rams in fluid communication with said reservoir to exhaust fluid from said rams for lowering said BOP and to a third position placing said pump in fluid communication with said reservoir while said check valves and said relief valves hold said rams in a static condition.

2. An apparatus as stated in claim 1 wherein said first means includes a shackle having an open-throat portion engaging one of said lateral lips, a pivot pin connecting said shackle to said upper end of an associated one of said cylinders and an elastic strap connected to said shackle and to another of said lateral lips for holding said shackle in engagement with said one lateral lip.

3. An apparatus as stated in claim 1 wherein each of said means includes a chain connecting each of said second ends of said piston rods to said BOP.

4. A method of lifting a BOP from a wellhead located within the confines of a drilling-rig sub-base having a rig floor including a network of I-beams each having a lateral lip, said method comprising the steps of:

locating a vehicle adjacent said wellhead, said vehicle having a reservoir of hydraulic fluid and a hydraulic pump provided thereon, said reservoir and said pump each including a fluid outlet and a fliuid inlet;

connecting said reservoir outlet to said pump inlet;

connecting said reservoir inlet to an outlet on a fluid-distribution valve;

connecting said pump outlet to an inlet on said fluid-distribution valve;

connecting first, second, third and fourth inlet-outlet ports on said valve to first, second, third and fourth hydraulic rams, respectively, each of said hydraulic rams including a cylinder and a piston rod;

connecting each of said cylinders to a lip on an I-beam;

connecting each of said pistons rods to said BOP; and positioning said valve to direct flid from said pump to said rams.

* * * * *